United States Patent [19]

Chipp et al.

[11] 3,941,305

[45] Mar. 2, 1976

[54] CONTAINERS WITH RECLOSABLE OPENING MEANS

[76] Inventors: Douglas Frank Chipp, 3955 Belanger St. E., Apt. 407, Montreal 408; Raymond Delorme, 4481 Gatineau, Chomedey, Laval, both of Quebec, Canada

[22] Filed: June 22, 1973

[21] Appl. No.: 372,489

[52] U.S. Cl. ..... 229/44 R; 229/23 R; 206/45.12

[51] Int. Cl.[2] ..... B65D 5/32; B65D 5/04

[58] Field of Search .... 229/23 R, 23 A, 37 E, 37 R, 229/43, 44 R, 45, 51 B; 206/45.12, 45.34, 45.32, 498

[56] References Cited

UNITED STATES PATENTS

| | | | |
|---|---|---|---|
| 2,420,773 | 5/1947 | Dorfman | 206/45.12 |
| 2,902,202 | 9/1959 | Fallert | 229/45 X |
| 3,338,505 | 8/1967 | Hughes | 229/45 X |
| 3,670,951 | 6/1972 | Smith | 229/43 |

*Primary Examiner*—Richard E. Aegerter
*Assistant Examiner*—Stuart S. Levy
*Attorney, Agent, or Firm*—Robert J. Schaap

[57] ABSTRACT

There is provided a container which preferably has a "knockdown" type body and with closure means characterized by being adapted to strengthen and retain the body in a desired shape when the latter is in an assembled condition, the closure means being characterized by being hingedly connected to the body to provide a reclosable opening for containers.

15 Claims, 16 Drawing Figures

CONTAINERS WITH RECLOSABLE OPENING MEANS

This application is related to copending application Ser. No. 372,490, filed June, 22, 1973.

This invention relates to containers.

More particularly, this invention relates to containers suitable for the transportation and storage of commodities; the containers of the present invention being characterized as being of a reclosable type having improved rigidity characteristics, as well as other advantageous features as described hereinafter.

There are a very large number of different types of shipping and display containers well known to those skilled in this art. One category of such containers comprises the reclosable type of container, which after opening, is adapted to be reused by providing suitable closure means which are capable of being removed and then replaced as desired. Reclosable type containers are basically one of two different types; first, those in which the closure means are adapted to be completely removed and in fact form a separate component of the container (they need not initially be a separate component, but rather may be connected to the container body by appropriate score lines which are adapted to be cut to permit initial opening and access to the contents of the container), secondly, a further type of reclosable container pertains to those which have closure means hingably connected to the container body. This invention pertains particularly to the latter type. In the latter type of container, different ways have evolved in the past for hingably connecting the closure means to the container body - through the use of physical hinges which could be of board, metal or the like which are fixed, at spaced apart points, to the appropriate closure panel and the container body to permit the closure panel to pivot about a fixed axis and thus permit the closure means to be opened and closed as desired. A more elementary type pertains to the use of closure means which are integrally connected to the container body, and generally are in the form of a closure panel pivotable about a crease or fold line of the container body. In the first type of "mechanical" hinge means, it is obvious that many additional operations are required necessitating additional labour and expenses. The second type of closable container, while economically advantageous, their effectiveness is quite limited for the reasons explained hereinafter.

Specifically, to provide a reclosable cover or the like for a container, the cover portion must include some structure which is capable of surrounding the opening of the container body to permit the same to "snugly" fit around the opening and be pivotable about the crease or fold line, or mechanical hinge. For most containers, this has involved providing the closure panel adapted to surround the opening of the container body, with downwardly extending panels on all sides of the closure panel (except that side which is hingedly connected to the container body), and to secure the flaps together by appropriate gluing steps, inserts, etc. to form a more or less "rigid" border, which can then relatively tightly fit or surround the container opening. Again, the fact that such additional means are generally limited to reinforcing the downwardly extending panels on three sides of the closure panel, this in itself creates additional problems, adds to the expense of the container in terms of additional assembly and operations required, etc.

Still further, most containers of the reclosable type are not of a "knockdown" type — that is, a type of container which may be collapsed and shipped in a flattened form to a consumer, and then erected and placed in an assembled condition. Obviously, where the closure means for the container are modified during manufacture to include additional strengthening or structural components to make it reclosable, the closure means cannot be readily collapsed without damage to the container.

However, with this invention, applicant has developed a novel type of reclosable container, which container includes a body portion, the body having an opening or aperture therein permitting access to the contents of the container and, re-openable closure means adapted to close the opening of the container. The containers of the present invention have closure means in the form of at least one panel hingably connected to the container body and located along a portion of the container body surrounding the opening therein, strengthening and retaining means connected to said closure panel and at least partially surrounding said panel with said strengthening and retaining means adapted to at least partially surround the opening of said container body, first cooperating engaging flanges associated with said strengthening and retaining means and extending inwardly thereof adapted to provide a bearing and engaging surface, and second cooperating and engaging flanges associated with said closure means positioned with respect to said closure panel whereby said second cooperating engaging flanges have end margins which are adapted to matingly engage said first cooperating engaging flanges of said strengthening and retaining means when said latter means is operatively mounted in relation to said closure panel whereby when said first and second cooperating engaging flanges are in mating relationship, said closure panel and said strengthening and retaining member may be opened and closed through said panel hingably connected to said container body. The strengthening and retaining member is preferably of a one-piece construction, and made from a rigid material. In this respect, the term rigid is used to describe material which is self-supporting and preferably of a substantially non-flexible nature. Typical materials from which this member may be made include synthetic materials, such as polypropylene, polyethylene, and the like; various metallic materials such as tin, steel, aluminum, etc. Again, in describing such materials as substantially non-flexible, it is intended to denote the fact that as opposed to materials which are capable of flexing under very nominal pressure, the material used to form the member, which when mounted in operative relationship to the closure panel, is capable of retaining its shape unon nominal pressure being exerted. The strengthening and retaining member of the closure means, as outlined above, may be characterized as forming one of the engaging means for the closure portion of the container, by virtue of a flange of the member extending inwardly thereof. To this end, the structure of the member includes a continuous side wall having an overall outline conforming to the container opening and thus, the strengthening member will have a shape or configuration conforming to the container opening. In the preferred form where the strengthening and retaining means completely surrounds the container opening, as opposed to only partially encircling such opening, it may thus have a rectangular, circular, hexagonal or the like configuration depending on the configuration of the container opening. However, it will be also understood that within the scope of this invention, the strengthening and retaining means may only partially encircle the container opening.

A particularly preferred form of the strengthening and retaining member is one in which the latter includes a generally U-shaped outline characterized by the previously defined side wall member, the previously defined flange extending inwardly of the side wall member on the lower or bottom edge thereof, and an upper top flange likewise position with respect to the side wall and therefore extending inwardly. Both flanges in the preferred embodiment will be at substantially right angles to the side wall, although it will be understood that this may vary so that the inwardly extending flanges may form an acute angle with the side wall. The depth of the respective flanges will depend on the characteristics of the material forming the strengthening and retaining member, as well as the type of material from which the container is made. As outlined above and hereinafter, the lower flange forms first cooperating engaging means associated with the second cooperating and engaging flange, whereby the flange of the strengthening and retaining member forms a bearing and engaging surface for the second flange. In the case of the upper flange or the additional flange connected to the side wall of the retaining member, it will function to position the retaining means in a proper relationship to the closure panel of the container. Still further, for aesthetic purposes, the width of the respective flanges of the strengthening and retaining members may be varied to provide relatively wide borders and simulate a wide container opening. Typically, the respective flanges may vary anywhere from 1/32 of an inch to ½ inch; generally speaking, the flanges may vary from 1/16 of an inch to ¼ inch for a smaller type container while in the case of larger type containers, these measurements will of course be greater.

Structurally, and depending on the geometrical configuration of the strengthening and retaining member, the flanges of the member may be notched or otherwise slit to compensate for the material being formed into, e.g., rectangular, pentagonal, circular or the like configurations. This will prevent crimping of the material in different angular configurations when it is formed into different shapes.

In one embodiment of the present invention, the closure panel associated with the closure means, which is adapted to close-off access to the container opening, may form an integral part of the strengthening and retaining member. To this end, the strengthening and retaining member may have the above described configuration but in which the aperture otherwise formed between the sides of the strengthening and retaining member include a closure panel integrally connected thereto or formed therewith; for example, a panel of suitable material may be fixedly attached to the uppermost flange of the strengthening and retaining member by suitable means (e.g., adhesives, etc.) which will depend on the type of material used to form the closure panel. Alternately, as described and illustrated hereinafter in the drawings, the closure panel is preferably integrally formed with the container body and upon assembly of the container, it is located between the borders defined by the strengthening and retaining member with the uppermost flange positioning the strengthening and retaining member in juxtaposition with the enclosure panel.

In a like manner, the height of the side walls of the strengthening and retaining member may likewise vary depending on several factors including the general size of the container, the desired aesthetic purposes, etc. As explained hereinafter, the height of the side wall will correspond generally substantially to the depth of the second cooperating and engaging flanges. Thus, its heighth or width is not critical except as mentioned with respect to the second cooperating and engaging flanges.

The strengthening and reinforcing member may be made by various different types of manufacturing processes and it suffices to say that those skilled in the art may readily understand the manufacture of the same upon reading the teachings of the present disclosure. In this respect, the strengthening and retaining means, as a separate component, will form one component of a knockdown type container having the advantageous features of the present invention, and due to their nature, they may be shipped separately and provided to a manufacturer of the container bodies per se for subsequent assembly to an erected container. Normally, for practice purposes, and having determined the type of container body and opening to which the strengthening and retaining means is adapted to be used in conjunction with, the strengthening and retaining members will be manufactured and given lengths, or alternately, in a continuous strip form, whereafter they may be dieformed into the desired shape and length. During the latter operation, the respective free ends of the lengths of material forming the strengthening and retaining means may be modified to include cooperating engaging means to permit the free ends to be secured together. Thus, for example, one free end may be provided with a tongue, the other with a notch or aperture therein adapted to receive the tongue whereupon the latter when inserted into the aperture, may be bent or otherwise secured to the side wall of the retaining means to form an assembled unit.

The body portion of the container of the present invention may be of any conventional construction - and to this end, it may be formed of a continuous or discontinuous wall structure. In other words, the body portion may be of a one-piece sheet material construction in which the opposed ends or opposed sides of the sheet are joined together by suitable means to form an enclosure adapted to contain or retain at least one commodity. In the case of the body per se being made up of several wall members, the individual wall members may be joined by suitable means, e.g., an adhesive or the like, to form a continuous wall structure. The geometrical configuration of the wall structure may be again any conventional shape, such as rectangular, triangular or circular. In this respect, the structure of the body portion of the container will preferably have one or more pairs of opposed fold lines adapted to permit the body to be collapsed, which fold lines may define the geometrical configuration of the container.

Conventionally, most containers used today are made of paper, paperboard or the like material and, as with conventional containers, the products of the present invention may likewise be made of any suitable conventional material. In addition to paperboard and the like material, and depending on the end use of the container, the containers of the present invention may be made of other materials such as resinous materials, e.g., cellophane, polyethylene, polypropylene, copolymers of the latter materials, metal foils, or laminates of plastic materials and metal foils or paper materials, etc. It will be made of self-supporting materials and to this end, the thickness of the different materials which may be employed for constructing the containers will vary not only in this factor, but also it will depend on other factors such as weight, economics, etc. Thus, typical material thicknesses will vary from, e.g., 1 mil to 10 mils or more. It should also be pointed out, in this respect, that when using paper, paperboard or metal foils or the like, fold lines in the material forming the container body can be provided by appropriate mechanical means well known to those skilled in this art; however, in the case of various types of plastic or resinous materials, in which the materials have the characteristic of being collapsible without the necessity of fold lines, the fold lines need not be applied.

An advantageous form of the present invention is to provide a container body, which is adapted to retain one or more desired commodities, with a type of construction permitting knockdown of the container, upon assembly of the components forming the body of the container; to this end, the above described fold lines may be provided appropriately in the blank for the container. However, in the case of other types of material, such as polyethylene or various celluloic materials, the containers may be collapsed without the necessity of providing fold lines.

The body of the container may be of any desired configuration and thus, rectangular, circular, etc. containers are within the scope of the present invention. To this end, and if desired, the body portion, or for that matter, the end portion(s) of the container may include one or more apertures for permitting visual inspection of the contents of the container — such apertures normally being covered by suitable transparent sheet material such as cellophane, plastics, particularly the thermoplastic material such as transparent polyethylene, transparent polypropylene, etc. To this end, the size and configuration of the aperture may vary and any suitable means may be provided for securing the transparent window material to the body of the container.

The products of the present invention may be made on existing equipment suitably modified, insofar as the individual components are concerned other than the strenghening and reinforcing member. Thus, in the case where the body of the container is made from a single piece of continuous sheet material, such as paper or paperboard, the appropriate blank for the container may be die cut from the sheet material and subsequently processed by providing the necessary one or more fold lines, score lines, etc. In the case where the body is made of plastic material, the said plastic material may be extruded in the form of the container desired — or in the alternative, the plastic material when provided in sheet form, may be thermo-molded or thermo-formed into the desired configuration. Conventional assembly steps may then be employed to assemble the die cut blanks, or in the case of non-thermoformed components, to assemble the same into a finished container. In this respect, following assembly or formation of the container and placing the same into a knockdown condition, the latter may then be reerected, where and as required, and the strengthening member then inserted into juxtaposition into one or both ends of the container, depending on how the container is structured.

The body of the container may have any opening of any desired configuration therein and, as such, the structure of the container body surrounding the opening need not be described in detail, except to say that the free edges of the material define the aperture through which access to the contents of the container may be had.

Although the body and opening in the body of the container may have any desired shape and size, a most preferred construction of the present invention involves the provision of the closure panel of the closure means being integrally connected to the container body. To this end, the body of the container preferably includes a first intermediate panel hingedly connected along a fold line, crease line or the like to the body, with the closure panel being integrally connected to said intermediate panel along a fold line and with the provision of the second cooperating and engaging flanges integrally connected to the closure panel. Thus, the closure panel, second cooperating and engaging flanges, and the body portion of the container most desirably form a one-piece integral unit. In this preferred construction, the flanges connected to the closure panel will normally be dimensioned so as to extend from the panel at a width slightly greater than the dimensions of the aperature in the container body, so as to at least partially surround exteriorly the opening of the container body. Preferably, the flanges connected to the closure panel are substantially continuous in the sense that they completely surround the opening of the container. On the other hand, they may be intermittent if desired, particularly when a continuous length of the strengthening and retaining means is provided to otherwise completely surround the opening of the container body. The flanges integrally connected to the closure panel will normally extend perpendicularly therefrom and as explained hereinabove, are adapted to lie in juxtaposition with the side wall of the strengthening and retaining member when the latter is placed in an assembled condition with respect to the closure panel. To this end, the depth of the flanges associated with the closure panel will be generally coextensive with the depth of the side wall of the retaining member. When continuous flanges are employed to substantially surround the opening of the container, the flanges may be "V-notched" at any corners of the container to facilitate assembly and prevent gathering of excess material at the corners of the container.

In an alternate embodiment, however, the containers of the present invention may include a first intermediate panel hingably connected to the container body and preferably integral therewith, with the flanges associated with the closure panel being directly connected to the said intermediate panel whereby there is utilized a separate closure panel associated with the strengthening and retaining member. In this embodiment, the flanges emanating from the said intermediate panel, and appropriately dimensioned, would be adapted to engage the flanges of the strengthening and retaining means and form with the separate closure panel associated with the strengthening and retaining means, a closure member. Thus, the flanges may be separately connected to the container body.

In the containers of the present invention, it will be appreciated that to form a reclosable container, the dimensioning of the strengthening and retaining means will be larger than the opening in the container body. To this end, as outlined above, the flanges associated with the closure means will likewise have a slightly greater dimension to permit the latter to lie in juxtaposition with the side walls of the container when the closure means is in a closed position.

The containers of the present invention can be manufactured in individual components — that is, the body portion, and the closure means, and where the containers are of a knockdown type, the separate components may then be shipped to a manufacturer or user of the containers. The knockdown body portions may then be erected and, the strengthening and retaining members may then be snapped into place after one or more commodities have been inserted into the container for packaging purposes.

In general, the containers of the present invention may be used for various purposes — in general, they will find wide application in the consumer packaging industry wherein one or more commodities are adapted to be retained, shipped and displayed in the same container. Thus, by way of specific example, the containers of the present invention may be used for shipping and transporting various types of commodities, for display purposes, etc.

The containers of the present invention have many advantageous features over the prior art containers in that they provide a very simple and aesthetically appealing reclosable container suitable for use for many different purposes. The containers have the further advantage that they may be readily manufactured on existing equipment and, provide strength characteristics combined with the advantageous features of knockdown type containers.

The container construction of the present invention may include a body portion having any desired bottom construction where such containers are of conventional side wall, top and bottom configurations. Thus, the bottom portion between opposed side walls may have inwardly extended flaps from the side walls of the body portion secured in any suitable manner.

Having thus generally described the invention reference will now be made to the accompanying drawings, illustrating preferred embodiments and in which.

Figures 1, 2, 3, 4:
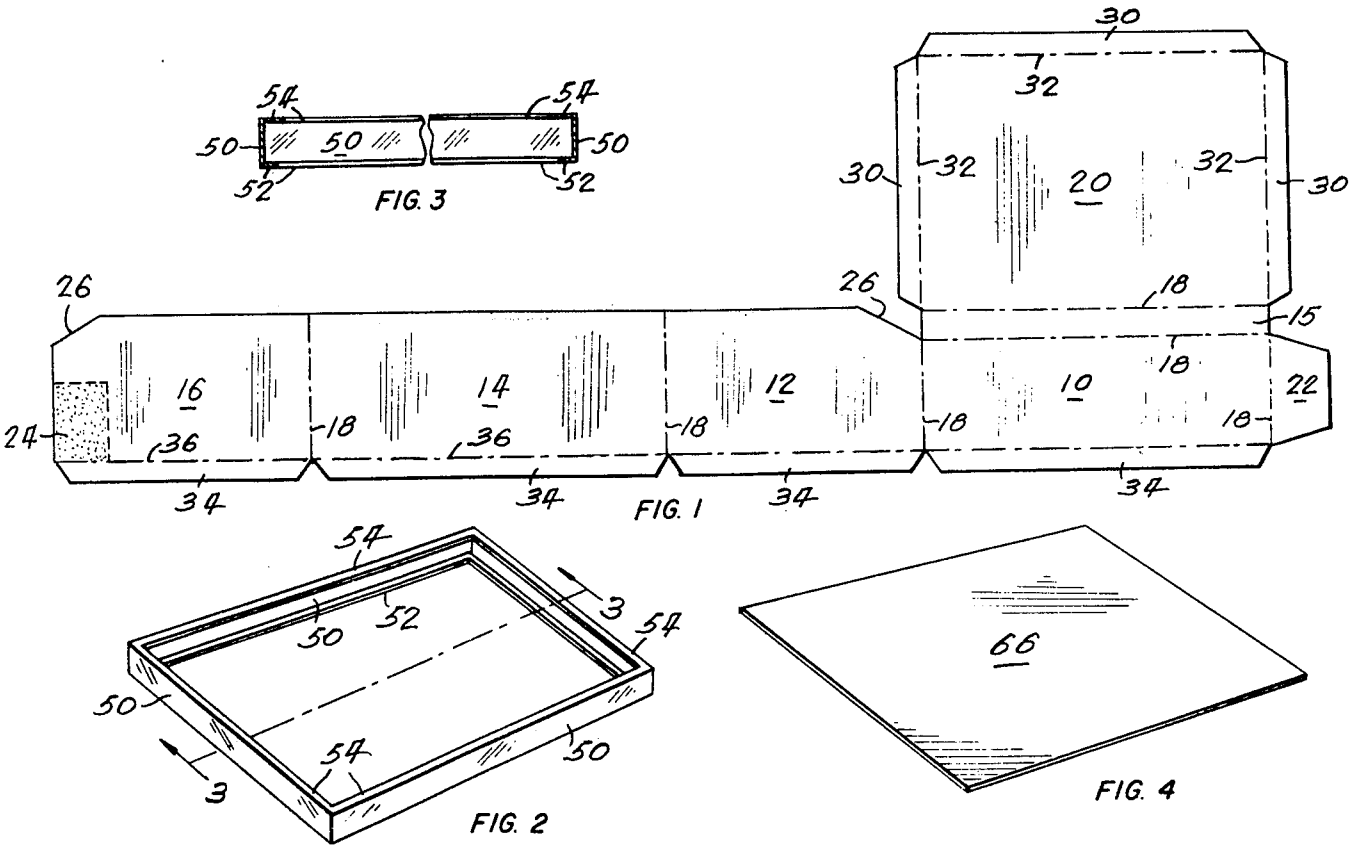
FIG. 1 is a plan view of a box blank which may be used to form a container of the present invention.
FIG. 2 is a perspective view of the strengthening and reinforcing member of the present invention.
FIG. 3 is a fragmentary section taken along the line 3—3 of FIG. 2.
FIG. 4 is a perspective view of a bottom panel for forming the bottom of the container.
Figure 6:
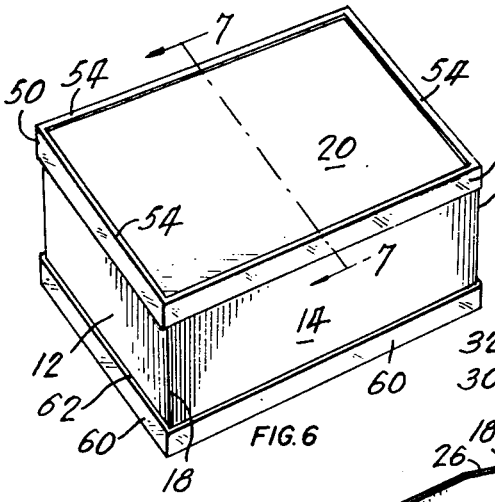
FIG. 6 is a perspective view of a container embodying this invention.

Referring initially to FIG. 1, there is illustrated a blank for forming a container of the present invention, which blank is capable of producing a rectangular type container. The blank for the container is a one-piece sheet material, such as paperboard or the like, and comprises a plurality of panels die cut from a single sheet with score lines or crease lines defining the respective panels. In more detail, the container of FIG. 6 in blank form as illustrated in FIG. 1 includes a rear panel 10, a first side panel 12, a front panel 14 and a second side panel 16. Crease lines 18 show the lines of demarcation between the respective panels, about which they are adapted to be folded to form a container body. To this end, panel 10 includes a side flap 22 integrally connected thereto with additional fold line 18 defining the line of demarcation between panels 10 and 22. In assembly, adhesive or the like may be used (as indicated by reference number 24 in FIG. 1) to secure panel 22 to panel 16 and form a closed body portion. Integrally connected to panel 10 is a relatively narrow intermediate hinge panel 15 with parallel fold or crease lines 18 defining the width of the panel. Connected along one side of panel 15 and integral thereto, is a top panel 20.

Each of the side panels 12 and 16, in the case of the rectangular type of container illustrated, include a cut-away portion to facilitate closing of the cover. The cut-away portion, indicated generally by reference numeral 26, tapers at an angle to the rear portions of the respective side panels.

The blank for the container illustrated in the drawings may be made of board material as outlined hereinabove, however other material may also be used depending on the end usage of the container.

In accordance with this invention, a container is characterized by having the top closure panel, which is of a reclosable nature, partially formed integral with the body of the container as defined by panels 10, 12, 14 and 16, in combination with a strengthening member illustrated in e.g., FIGS. 2 and 3 in detail. To this end, the top panel 20 of the container includes marginal flaps 30 along the three free sides of the top panel, and to facilitate the bending of the flaps 30 for the purpose hereinafter defined, crease lines 32 are provided. In the container illustrated, the bottom portion of the container is likewise constructed as the top cover portion is; and to this end, flaps 34 are provided along the free lower edges of each of the panels 10, 12, 14 and 16, with crease or fold lines 36 being included to facilitate bending of the flaps 34 to form flanges. Each flap 34 is of an equal heighth; as is the case with each of flaps 30 of the top panel 20.

Referring specifically to FIGS. 2 and 3, there is illustrated a strengthening and closure member suitable for using in conjunction with the top portion 20 of a container, which strengthening member comprises a one-piece unit of (in this case) metallic material. Structurally, it includes a continuous side wall 50 and an inwardly extending flange 52 located at substantially right angles to the side wall 50. The flange 52 forms a cooperating abutting surface as explained hereinafter. In a preferred form, the strengthening member further includes a top flange 54 likewise preferably located at substantially right angles to the side wall 50 and extending inwardly therefrom.

Figure 7:
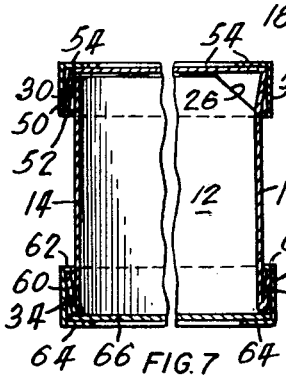
FIG. 7 is a section taken along the line 7—7 of FIG. 6.
Figure 8:
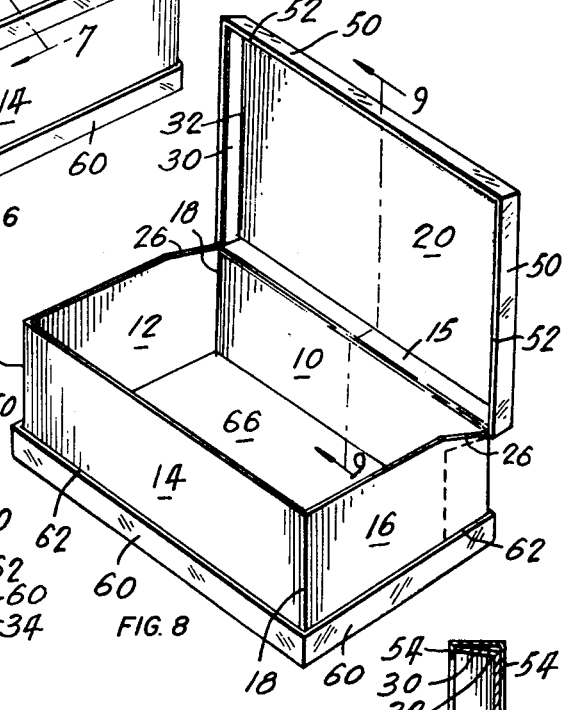
FIG. 8 is a perspective view of the container of FIG. 7 showing the closure means in an "open" position.
Figure 5:
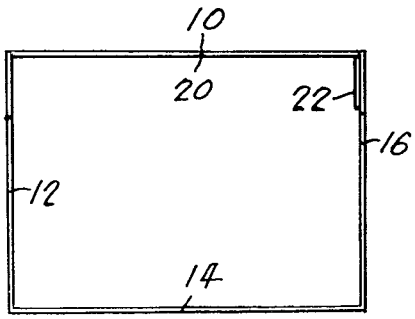
FIG. 5 is a plan view of a horizontal section taken through a typical container of the present invention as more specifically illustrated in FIG. 6.
Figure 9:
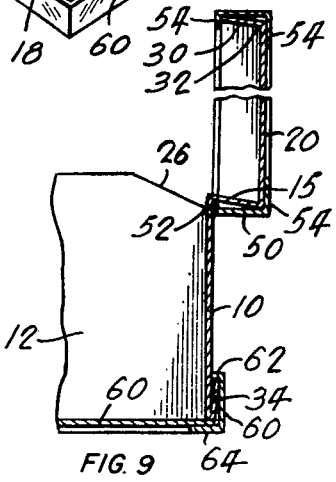
FIG. 9 is a section taken along the line 9—9 of FIG. 8.
Figure 10:
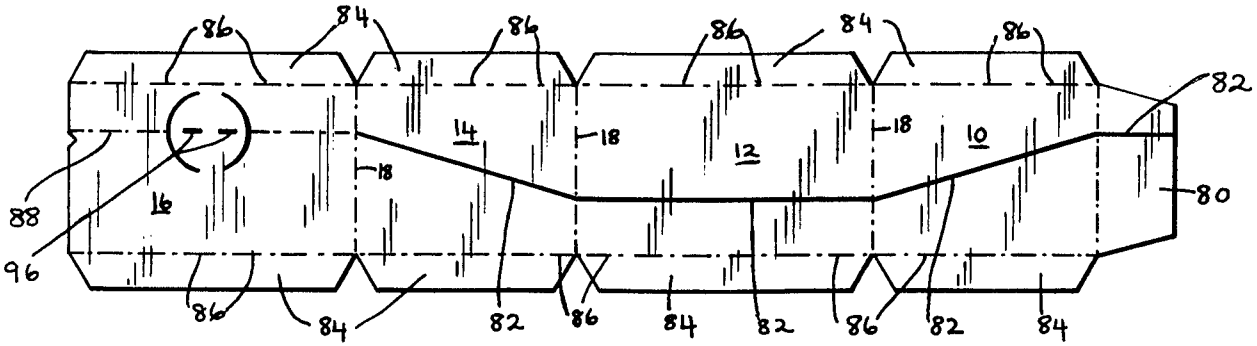
FIG. 10 is a top plan view of a blank for the body of the container.

The depth of the side wall 50 corresponds substantially to the depth of the flaps 30 so that when the flaps 30 are folded downwardly at substantially right angles to the top closure panel 20, they form bearing flanges adapted to engage the inwardly extending flange 52 of the side wall 50, as illustrated in greater detail in FIGS. 7, 8 and 9. In this respect, the upper flanges 54 form bearing surfaces adapted to engage the surface of top panel 20 and position the strengthening member about the top panel 20. In this manner, the strengthening and reinforcing member may thus be positioned about the top panel and its downwardly extending flaps 30 to form a rigid top opening member for the type of container illustrated in the drawings.

It should be mentioned, with respect to the strengthening member illustrated in FIGS. 2 and 3, and as otherwise depicted in the drawings mounted on the container, that the one-piece construction described above may actually be a continuous piece of metallic "U"-shaped channel having an appropriate length corresponding to a length sufficient to encompass the top panel 20. To this end, an appropriate length of such U-shaped channel material may be provided, and the respective free ends of the channel connected by appropriate means; preferably, one free end is provided with a tongue or the like first engaging means while the other free end is provided with a recess adapted to receive the tongue and to permit the tongue to be inserted therein and engaged in a fixed manner. However, other alternate arrangements may likewise be utilized if desired.

In constructing the container, and for the purposes of making it a reclosable-type container, the top panel 20 will normally be dimensioned so as to be substantially the same as or slightly larger than the area (in configuration) than the body of the container as defined by the side walls, 10, 12, 14 and 16. Thus, upon mounting of the strengthening member about the top panel, and due to the hinged nature of the container struction (that is, hinge 15 connecting top panel 20 by fold or crease lines 18 to the back or rear panel 10) the top panel may be opened and closed as desired to provide a tight-fitting cover.

The bottom construction of the container may be any conventional type of construction as desired. In the embodiment illustrated, a preferred form is shown in which the bottom portion likewise includes a strengthening member of the same general character described above with respect to the top portion of the container. Thus, the bottom strengthening member includes a continuous side wall 60 with a first inwardly extending flange 62 located substantially at right angles to side wall 60, and a bottom flange 64 disposed in a substantially identical manner. There is thus formed a further U-shaped channel and, due to the nature of the foldable flaps 34 depending from the bottom portion of each of the side panels 10, 12, 14 and 16, which are adapted to be outwardly folded in the manner illustrated in FIG. 7, the flaps 34 are adapted to engage the inwardly extending flange 62 of the U-shaped channel so as to provide a tight-fitting arrangement. To provide a bottom closure panel, there is provided a one-piece sheet material 66 (FIG. 4) which is dimensioned to be received within the border as defined by the U-shaped channel for the bottom portion of the container, and specifically adapted to be dimensioned to fit within the side walls 60 while being supported by the bottom flange 64. Thus, in assembly, the bottom panel 66 is initially mounted in the U-shaped channel strengthening member and, this latter component then assembled or "snapped" onto the bottom portion of the container while the flaps 34 are folded in an outwardly and upwardly extending manner whereby the flaps 34 lock or otherwise engage with the flanges 62.

Referring now in greater detail to FIGS. 10 to 16, the container body in this embodiment is comprised of a one-piece blank of suitable sheet material, as for example, cardboard, paper-backed plastic coated board, heavy kraft liner, etc.

In this respect, similar reference numerals as used in the original disclosure have been used to designate similar parts.

Thus, the body includes panels 10, 12, 14 and 16 adapted to form a rectangular container, panels 10 and 12 being joined together along a fold line 18; panels 12 and 14 along a fold line 18; and panels 14 and 16 likewise along a fold line 18. In this embodiment, panels 10 and 14 form an opposed pair of side panels; likewise panels 12 and 16 form an opposed pair of front and back panels respectively for the container body. Panel 10 includes a side extension indicated generally by reference numeral 80, which is adapted to be secured to the panel 16 when the blank is in an assembled condition — attachment being by suitable means such as an adhesive, heat sealing (depending on the type of material), etc.

As will be seen from FIGS. 10, 11, 14 and 15, the panels 80, 10, 12 and 14 are provided with a separation line which is cut through the material forming the panel — the cut line being indicated generally by reference numeral 82. This cut line 82 actually divides the panels 80, 10, 12 and 14 into two separate portions — the cut line 82 in panels 10 and 14 being substantially mirror images of the other; the cut line 82 in panel 12 being generally horizontal to the longitudinal axis through the blank for the container; and the cut line 82 in panel 80 forming a continuation of the cut line 82 in panel 10. The configuration of the cut line 82 determines the upper and lower portions of the respective panels and the type of opening as is desired in the assembled container (see FIG. 15).

Each of the panels 10, 12, 14 and 16 is provided with a pair of laterally extending end flaps indicated generally by reference numeral 84. These flaps are connected to the respective panels along fold or crease lines 86, and each pair of flaps connected to a given panel is of substantially the same dimensions — although this may vary depending on the size and type of strengthening and reinforcing member used in conjunction with assembly of the body of the container.

Figure 11:
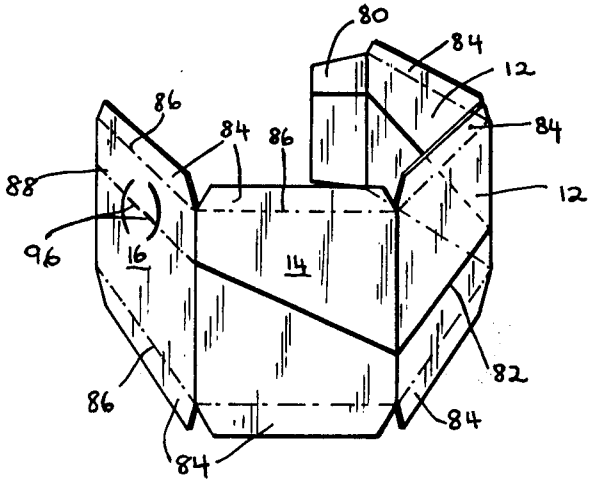
FIG. 11 illustrates the container blank being partially formed into the body of the container.

In assembly of the container body, the various panels 10, 12, 14 and 16 are folded about fold lines 18 to assume the configuration generally shown in FIG. 11, whereafter both portions of the end panel 80 are fixedly secured to the panel 16. It is to be understood in this respect that panel 80 may be located on panel 16 if desired.

Figure 12:
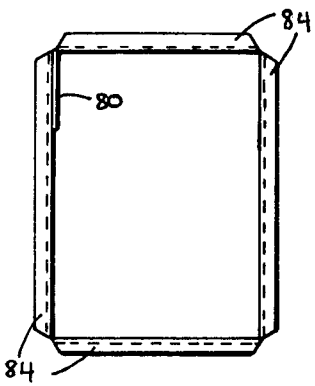
FIG. 12 is a top plan view of an assembled container body.
Figure 13:
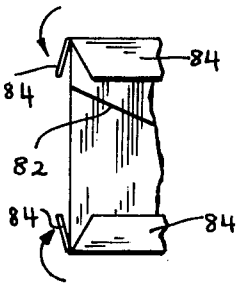
FIG. 13 is a partial side elevational view showing folding of the projecting flaps on the side panels of the container prior to placement of the strengthening and retaining member about the container body.
Figure 14:
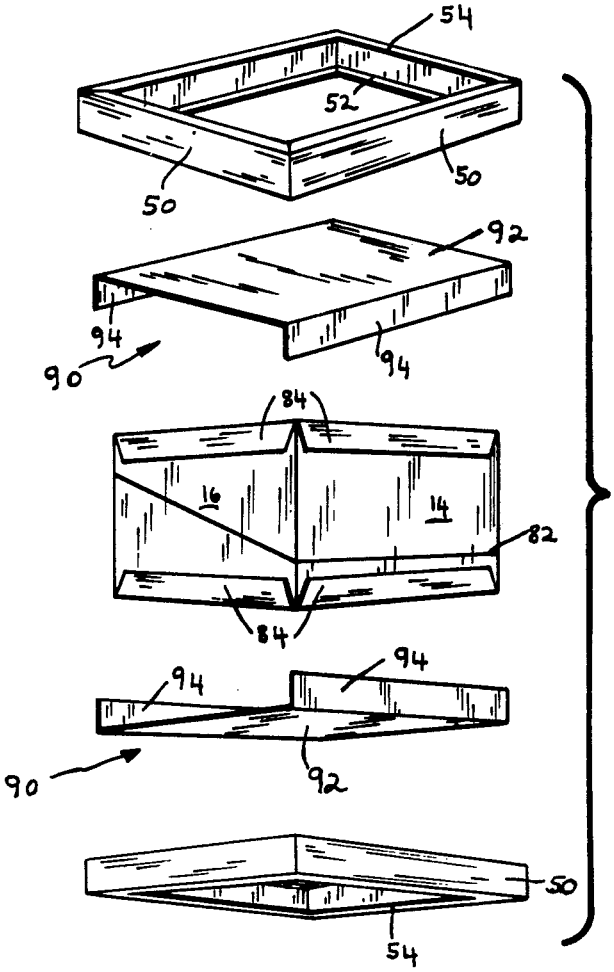
FIG. 14 is an exploded view of a typical container according to the present invention.
Figure 15:
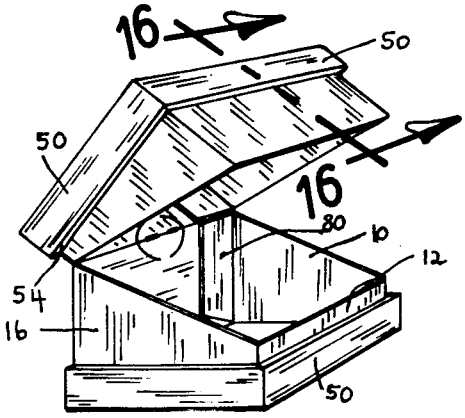
FIG. 15 is a perspective view of a container according to this invention showing it in opened form.

In this manner, there is thus obtained an assembled container body as shown in FIGS. 12 and 14, in which panels 10, 12 and 14 permit the container body to be separated into two portions, folding about a fold line 88 in panel 16. Fold line 88 may be located at any appropriate heighth commensurate with the location of the cut line 82.

The containers of the present invention utilize a strengthening and reinforcing member as described therein — again, similar reference numerals have been used to designate similar components with respect to this member. This member, as shown in FIG. 2 and in FIG. 14, includes a lateral side wall 50 and opposed inwardly extending lower and upper flanges 52 and 54 respectively. In this embodiment, similar strengthening and reinforcing members are used for the top and bottom of the container body; likewise, again in this embodiment, both of the strengthening and reinforcing members may include an insert indicated generally by reference numeral 90 which form upper and lower top and bottom closures for the container body. These members 90 thus include a one-piece continuous panel of suitable material, e.g., the material from which the container body is made, and have a continuous flat closure panel portion 92 and a pair of optional side flaps 94 connected along a fold line to the panel 92. If desired, there may also be provided a further pair of side flaps on the other free ends of lateral sides of the panel 92.

For assembled purposes, and with particular reference to FIG. 14, the end closure panels 90 are initially inserted into the strengthening and reinforcing members 90 whereby the side flaps 94 engage the upper and lower flanges 52 and 54 of the strengthening and reinforcing member (see FIG. 16) to position the closure panel 92 therein. Thereafter, the side flaps or panels 84 of each of the main panels 10, 12, 14 and 16 are outwardly folded in the manner illustrated in FIG. 13 and, the strengthening and reinforcing member "snapped" into position about the container body to arrive at the configuration illustrated in FIGS. 15 and 16.

Figure 16:
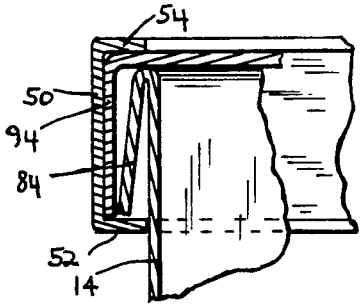
FIG. 16 is a section taken along the line 16—16 of FIG. 15.

As described in the original disclosure, preferably the body of the container is dimensioned so as to generally substantially tightly fit the area bounded by the flanges 52 and 54 of the strengthening and reinforcing member whereby the flaps or panels 84 are adapted to engage the inwardly turned flanges of the strengthening and reinforcing member. Again, preferably these flanges are dimensioned so that the flaps 84 extend in an angled manner when in a locked position thereon (as illustrated in FIG. 16) but it will be appreciated that various modifications can be made on this principle.

It will be understood that various modifications can be made to the above described embodiments without departing from the spirit and scope of the invention. For example, the rear panel 16 may include two or more cut-through or skip lines to facilitate folding of the upper portion of the container about the lower portion thereof, such lines being indicated generally by reference numeral 96 in FIG. 10.

We claim:

1. A reclosable container comprising in combination a knockdown body portion forming a cavity to retain a commodity therein, said body portion having at least first and second body-forming walls, and said body forming walls each respectively having first and second end margins thereon, said body portion having an aperture communicating with said cavity to permit loading of a commodity therein, closure means including a closure-forming panel operatively hingedly connected to the first end margin on the first of said body-forming walls and capable of being shifted to a closurewise position over said aperture, said closure-forming panel having at least first and second end margins thereon and being substantially parallel to said body-forming walls and being coextensive with at least one of said body-forming walls when the closure means is in an open position and substantially perpendicular to said body-forming walls when the closure means is in the closurewise position, a flap extending from a first of the end margins on said closure-forming panel and capable of being struck in a direction where it lies substantially in perpendicular relation to the exterior surface of said closure-forming panel, a strengthening and retaining frame which has a shape substantially conforming to the shape of said closure means at least partially surrounding said closure-forming panel, said strengthening and retaining frame having a side wall formed of a reinforcing material, and first and second flanges extending inwardly substantially perpendicularly from said side wall and being spaced apart from each other by a distance approximately equal to the length of said flap, said side wall of said strengthening and retaining frame being substantially parallel to said first and second body-forming walls when said closure means is in the closurewise position, said first end margin of said closure-forming panel being operatively retained by the first flange on said side wall and the outer end of said flap snugly engaging the second flange on said side wall when said strengthening and retaining frame is assembled with said closure means, said flap being located substantially in parallel relationship to one of said body-forming walls when the closure means is shifted to the closurewise position, said second flange having a bearing surface which faces said first flange and retentively engaging the outer end of said flap, said bearing surface having a width substantially greater than the thickness of said outer end of said flap, said first end margin on said closure-forming panel engaging said side wall and being retained by said side wall and said first flange when said strengthening and retaining frame is assembled with said closure means, whereby said closure means and said strengthening and retaining frame may be opened and closed with respect to the aperture in said body portion through the hinged operative connction of said closure-forming panel to one of said body-forming walls.

2. A container, as defined in claim 1, wherein said body portion comprises a plurality of body-forming walls forming a generally rectangular body for said container, bottom closure means connected to said body portion to form a body suitable for retaining at least one commodity therein.

3. A container, as defined in claim 1, wherein said body portion is a one-piece integral construction.

4. A container, as defined in claim 1, wherein said strengthening and retaining frame is formed of a rigid reinforcing material which is different than the material in the body portion and the closure means.

5. A container, as defined in claim 1, wherein said strengthening and retaining frame comprises a one-piece continuous substantially rigid body including said side wall adapted to encircle the closure means, the flanges on said one-piece member being substantially coextensive with the aperture in said body portion and being inwardly turned towards the body portion of said container when said closure means is in the closed position.

6. A container, as defined in claim 1, wherein said strengthening and retaining frame comprises a continuous member, said member being of generally U-shaped configuration characterized by said side wall and said pair of spaced-apart flanges inwardly extending from said wall on either side thereof, one of said flanges forming a cooperating and engaging flange associated with said strengthening and retaining frame, the other of said flanges forming a positioning flange adapted to position said strengthening and retaining frame with respect to said closure means.

7. A container, as defined in claim 1, wherein said closure-forming panel is hingedly connected to one of said body-forming walls through an intermediate panel.

8. A container, as defined in claim 1, wherein said body portion includes a plurality of body-forming walls defining a body for containing at least one commodities, said body-forming walls being foldable about one or more fold lines to provide a knockdown container.

9. A container, as defined in claim 1, wherein said closure-forming panel is provided with at least a pair of substantially perpendicularly struck flaps having a size substantially equal to the distance between the first and second flanges on said side wall, said closure-forming panel engaging the first of said flanges and the free end margins of said substantially perpendicularly struck flaps snugly engaging the second of said flanges on said side wall.

10. A container, as defined in claim 9, wherein said body portion is orthogonal in shape, the first of the end margins on said closure-forming panel are upper end margins of said flaps, said first and second flaps are struck downwardly to lie substantially in parallel relationship to the exterior surfaces of said first and second body-forming walls, and the flanges on said strengthening and retaining frame are upper and lower spaced apart flanges.

11. A container, as defined in claim 9, wherein the flaps attached to the closure means of said container are integrally connected to said clousre means and with said closure-forming panel completely encircling said aperature.

12. A container, as defined in claim 11 wherein comprising a body portion formed by a plurality of body-forming walls and each of said body-forming walls having opposed end margins thereon, the closure-forming panel integrally hingedly connected to a body-forming wall of said body portion at a point which is not contiguous with the end margins on one side of the other body-forming walls.

13. A container, as defined in claim 1, wherein said container has a body portion suitable for retaining at least one commodity, said body portion having said closure-forming panel hingedly connected to one said body-forming wall along a fold-line thereon defining a portion of said opening, said closure-forming panel having a pair of opposed free end portions, a further closure-forming panel extending from another body-forming wall and cooperating with said first closure-forming panel to form said closure means.

14. A container, as defined in claim 1, said container comprising an intermediate closure panel being associated with said container body through said closure-forming panel hingedly connected to said container body, said intermediate closure panel having a plurality of flanges extending therefrom on the free edges thereof, said intermediate closure panel having a dimension slightly greater than the dimension of the opening of said container, said pair of opposed spaced-apart flanges having a depth substantially equal to the flanges extending from said intermediate closure panel with said latter flanges being adapted to be positioned in juxtaposition to said side wall of said strengthening and retaining frame when said strengthening and retaining frame is mounted in operative relationship to said closure-forming panel.

15. A reclosable container comprising in combination a generally rectangular shaped knockdwon body portion forming a cavity to retain a commodity therein, said body portion having a plurality of rectangularly located body-forming walls, and said body-forming walls each respectfully having first and second end margins thereon, said body portion having an aperture communicating with said cavity to permit loading of a commodity therein, closure means including a closure-forming panel operatively hingedly connected to the first end margin on the first of said body-forming walls and capable of being shifted to a closurewise position over said aperture, said closure-forming panel having a first pair and a second pair of end margins thereon and being substantially parallel to said body-forming walls and being coextensive with at least one of said body-forming walls when the closure means is in an open position and substantially perpendicular to said body-forming walls when the closure means is in the closurewise position, a flap extending from at least three of the end margins on said closure-forming panel and each being capable of being struck in directions where they lie substantially in perpendicular relation to the exterior surface of said closure-forming panel, a strengthening and retaining frame which has a shape substantially conforming to the shape of said closure means at least partially surrounding said closure-forming panel, said strengthening and retaining frame having a side wall formed of a reinforcing material, and first and second flanges extending inwardly substantially perpendicularly from said side wall and being spaced apart from each other by a distance approximately equal to the length of each of said, flaps, said side wall of said strengthening and retaining frame being substantially parallel to all of said body-forming walls when said closure means is in the closurewise position, at least three end margins of said closure-forming panel being operatively retained by the first flange on said side wall and the outer end of said flaps snugly engaging the second flange on said side wall when said strengthening and retaining frame is assembled with said closure means, said flaps being located substantially in parallel relationship to at least certain of said body-forming walls when the closure means is shifted to the closurewise position, said second flange having a bearing surface which faces said first flange and retentively engaging the outer end of said flaps, said bearing surface having a width substantially greater than the thickness of the said outer end of said flaps, said last named three end margins on said closure panel engaging said side wall and being retained by said side wall and said first flange when said strengthening and retaining frame is assembled with said closure means, whereby said closure means and said strengthening and retaining frame may be opened and closed with respect to the aperture in said body portion through the hinged operative connection of said closure-forming panel to one of said body-forming walls at a fourth margin on said closure-forming panel.

* * * * *